US006315473B1

(12) United States Patent
Slippy

(10) Patent No.: US 6,315,473 B1
(45) Date of Patent: Nov. 13, 2001

(54) MULTIPLE SENSOR CONTINUOUS MEDIA DETECTION

(75) Inventor: Jamison B. Slippy, Middleton, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/490,737

(22) Filed: Jan. 25, 2000

(51) Int. Cl.[7] ..... B41J 13/00; B41J 29/24
(52) U.S. Cl. ..... 400/578; 400/709
(58) Field of Search ..... 400/578, 709

(56) References Cited

U.S. PATENT DOCUMENTS 2,902,765 * 9/1959 Chater ..... 33/125
5,110,106 * 5/1992 Matsumura et al. ..... 271/9
5,343,142 * 8/1994 Sasaki et al. ..... 324/71.1
5,875,033 * 2/1999 Kawata et al. ..... 358/296

FOREIGN PATENT DOCUMENTS

100001227-A * 1/1998 (JP) .
11011689-A * 1/1999 (JP) .

* cited by examiner

*Primary Examiner*—John S. Hilten
*Assistant Examiner*—Charles H. Nolan, Jr.
(74) *Attorney, Agent, or Firm*—Leslie G. Murray

(57) ABSTRACT

A sensor assembly for measuring the displacement or position of a movable member. The sensor assembly utilizes two or more smaller, less accurate sensors to perform the function of a single, more accurate larger sensor. The resolution of each of the smaller sensors is increased by configuring the sensor system such that the maximum travel of each sensor in a direction covers half or less of the travel of the moveable member being measured. Each sensor then moves in an opposite direction to return to its original position for the remainder of the travel of the movable member. Utilizing a cam follower system, two sensors generate a set of output signals at each position of the moveable member in a one-to-one correlation over the range of travel of the moveable member.

20 Claims, 3 Drawing Sheets

MULTIPLE SENSOR CONTINUOUS MEDIA DETECTION

FIELD OF THE INVENTION

The present invention relates generally to printers and printing systems, and more particularly to a system for automatically detecting and measuring the size of print media loaded in a print media supply bin for printing.

BACKGROUND OF THE INVENTION

Present day imprinting mechanisms, for example, electrophotographic copiers, laser printers, inkjet printers and the like, are generally capable of handling more than a single size of print media. An automatic manner of sensing the size of print media which has been loaded in a supply bin for inputting to a printing mechanism is the subject to be addressed herein. The print media may be any type of substantially flat material, such as plain paper, specialty paper, card-stock, fabric, transparencies, foils, mylar and the like, but the most common type or print media is paper. For convenience, I will discuss printing on paper as a representative example of these various types of print media. The media may be supplied to the printing mechanism in a variety of different sizes. For instance, in desktop inkjet or laser printers, paper is typically supplied in a stack of cut-sheets, such as letter size, legal size, or A-4 size paper, which are loaded or placed in a supply bin or input tray for subsequent input to the printing mechanism. Smaller sized envelopes or postcards or other media sizes may also be used for printing. Typically, the media sheets, cards or envelopes are sequentially pulled from the top of the stack and printed on, after which the printed sheets are deposited in an output tray.

It is desirable to have a printer which can measure and communicate what size media has been loaded in the input tray to the printer controller and to a host computer, particularly when the printer is not within sight of the computer user, such as when several computer users on a networked system share a printer or printers. Even when a printer is located on the users desktop, it may be helpful to provide the user with a warning if the wrong size media is loaded for a particular print job. This would tell the user to load the proper size media, or to adjust the print job parameters to fit the size of the loaded print media.

Automatic media size sensing must be highly accurate to be useful. In order to avoid toner contamination in the mechanism, this is particularly true for printing mechanisms which are capable of printing to the edges or near the edges of the sheets of print media. Sensing of media length and width is a feature often found in high-end printers and plotters for business and industrial use. However, these size sensing devices are typically quite cost-sensitive and general application sensing devices of the quality required can be very costly. Typically, for the small business and home markets where there is much more price sensitivity, automated media type detection has not been economically viable.

In the past, various methods have been used for media size determination. For example the use of a retroflective photo diode or a capacitance sensor mounted at some point in the printer paper path or on the print carriage to detect leading and trailing or side edges of the media sheet. However, retroflective and capacitive sensors are themselves expensive with the added direct and indirect costs incurred due to where within the printer the sensors are mounted and operate. Linear variable resistive and capacitive sensors mounted within the input paper tray tend to be less expensive than other methods, but, nevertheless, sensors of the required accuracy and sensitivity are expensive.

For example, one method of print media size detection utilizes a linear potentiometer mounted in the input paper tray. While this method provides a continuous output (i.e., a smooth function of output versus position), it can be either expensive, using large sensor components, or have lower accuracy due to scaling down the traverse with gears, levers or the like, and using smaller potentiometers. Another method is to use absolute encoders (optical, magnetic, etc, for example) to measure the true position of a movable member. In a printing mechanism supporting sizes of A-5 ledger media (222 mm of travel), an encoder would require 8 bits of resolution for 1 mm accuracy. Again, this can be expensive.

Accordingly there is a need for a sensor for determining what size print media is loaded in a printer input or supply tray having sufficient accuracy to be useful yet inexpensive enough to be utilized for low-end applications such as small business and home use.

SUMMARY OF THE INVENTION

In a preferred embodiment, the present invention provides a sensor assembly that measures the displacement of one member with respect to another member with a high degree of accuracy and at a low cost. A sensor assembly embodying the present invention utilizes multiple low cost, smaller sensor components to provide a less expensive and more accurate sensor assembly that a single, larger sensor performing the identical task.

In one embodiment the present invention provides a sensor assembly for measuring the displacement of a movable member. The sensor assembly utilizes two or more smaller, less accurate sensors to perform the function of a single, larger sensor. Each sensor includes a movable portion and a stationary portion, each sensor generating an output signal in response to movement of the movable portion with respect to the stationary portion. In one embodiment, the sensors are attached to a movable member while the movable portion of each sensor is in contact with a contoured surface of a stationary member. Movement of the moveable member causes the moveable portion of each sensor to move along and follow the contoured surface of the stationary member, which, in turn, causes movement of the movable portion of each sensor relative to the stationary portion of the sensor. The amount of movement of the movable portion of the sensor is proportional to the displacement of the movable member with respect to the stationary member. The portion of the contoured surface each sensor movable portion is in contact with has a different profile. As a result, for a given displacement of the movable member, the movable portion of each sensor will have a different amount of travel with respect to the sensor stationary portion, and thus produce a different output signal. The contoured surface of the stationary member is profiled to reverse the direction of motion of each of the movable portions with respect to the stationary portions at least once over the range of movement of the movable member. The output signals of the two or more sensors then form a set which uniquely identifies the displacement which produced the set of output signals.

In a preferred embodiment, the present invention is embodied in a printer to provide an apparatus for measuring the size of print media sheets loaded in a print media supply bin. The supply bin (i.e., input paper tray) includes a movable member which serves as a print media fence or stop mounted and disposed at a variable position within the supply bin. The position of the movable member is adjustable to allow print media sheets of differing sizes to be loaded in the supply bin. At least two sensors are mounted on the movable member. Each sensor includes a movable portion and a stationary portion, the movable portion of each sensor contacting an associated contoured surface of the supply bin. In response to displacement of the movable member with respect to the supply bin, the movable portion of each sensor follows its associated contoured surface thereby producing movement of the movable portion with respect to the stationary portion. The stationary portion of each sensor includes a variable electrical element which is responsive to movement of the movable portion with respect to the stationary portion to generate an output signal indicative of the displacement of the movable member with respect to the supply bin. The output signals generated by the at least two sensors are indicative of a unique position of the movable member with respect to the supply bin. The unique position is then associated with a print media sheet size.

In one preferred embodiment, the sensor variable electrical element may be a variable resistance, the sensor forming a linear potentiometer, and the output signals generated by the sensors forming a unique set of values for each unique position of the movable member within the supply bin. In a preferred embodiment, each unique set of values corresponds to and forms a pointer to a print media sheet size held in a lookup table, each unique position of the movable member corresponding to a different print media sheet size.

Other embodiments and advantages of the present invention will be readily appreciated as the same become better understood by reference to the following detailed description, taken in conjunction with the accompanying drawings. The claims alone, not the preceding summary or the following detailed description, define the invention.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the following detailed description illustrate by way of example the principles of the present invention. The components in the drawings are not necessarily to scale, emphasis instead being placed upon clearly illustrating the principles of the present invention. In the drawings like reference numbers indicate identical or functionally similar elements throughout the several views thereof, and wherein.

DETAILED DESCRIPTION OF THE INVENTION

Figure 1:
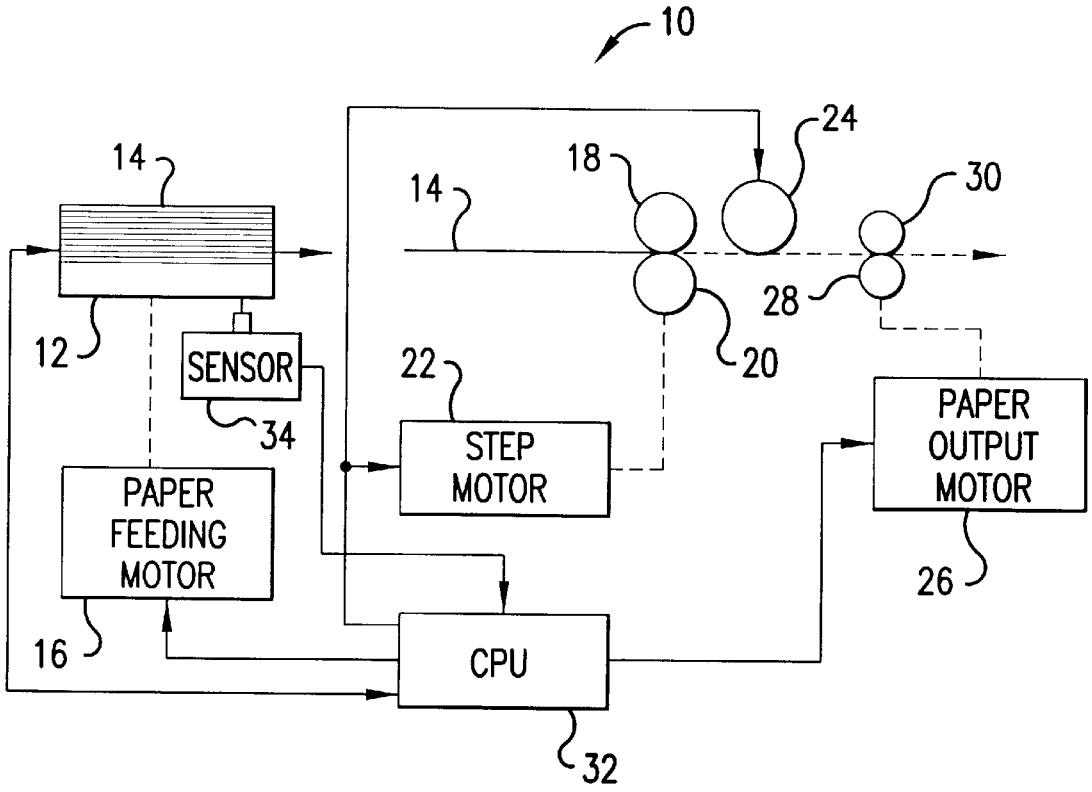
FIG. 1 is a block diagram illustrating a typical printing system paper conveyance mechanism including a print media sheet size detector according to the principles of the present invention.

As shown in the drawings for purposes of illustration, the present invention is preferably embodied in a sensor assembly which measures the displacement or position of a movable member with respect to stationary member. In one embodiment of the invention, two or more relatively small and inexpensive sensor elements are utilized to measure position or displacement with greater accuracy and at less expense than when using a single, larger and more accurate sensor to perform the same measurement.

Referring now to FIG. 1, a block diagram illustrating a typical printing system paper conveyance mechanism including a print media sheet size detector according to the principles of the present invention is shown. The printing system 10 includes one or more print media supply bins, such as paper input tray 12, wherein sheets 14 of print media, such as paper, are stacked (i.e., loaded). The media feed portion of the print system 10 includes a media feed motor 16 mechanically coupled to the input tray 12 which conveys the media sheets 14 to a pinch roller 18 and an input or draw-in capstan roller 20. A media conveyance means, such as step motor 22 is mechanically coupled to the capstan roller 20 draw the sheets 14 of print media into the printer and further convey the print media 14 to a print mechanism or print engine. The print engine may, for example, be the printing mechanism for a laser printer including a photoconductive drum 24. Alternatively, the print mechanism may be an inkjet or sublimation color printer, for example. A media output portion of the print system 10 includes an output motor mechanically coupled to an output capstan roller 28 and another pinch roller 30. As a sheet 14 of print media moves through the print engine past the photoconductive drum 24, for example, the media sheet 14 is received by the output capstan 28 and pinch roller 30 and conveyed out of the print mechanism to an output tray or other receptacle (not shown). A central processing unit (CPU) 32 controls the overall operation of the printing system 10 from the print media feeding to the print media output.

In accordance with the principles of the present invention, a print media size sensor 34 is electrically and mechanically coupled to the media input tray 12. The sensor 34 automatically detects the size of the sheets 14 of print media stacked in the input tray 12 and transmits the print media size information to the CPU 32. The CPU 32, then, uses the print media size information to control the feeding of sheets 14 of print media to the print mechanism and the operation of the step motor 22 and output motor 26 thus providing the conveyance of the print media through the print system 10 and allowing a continuously printing operation.

Figure 3:
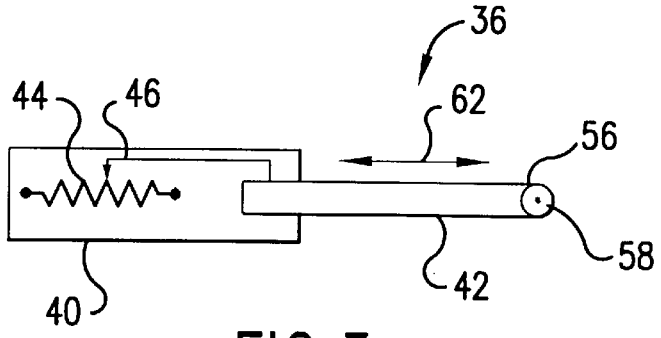
FIG. 3 is a schematic drawing illustrating the detail of a sensor element shown in FIG. 2.
Figure 2:
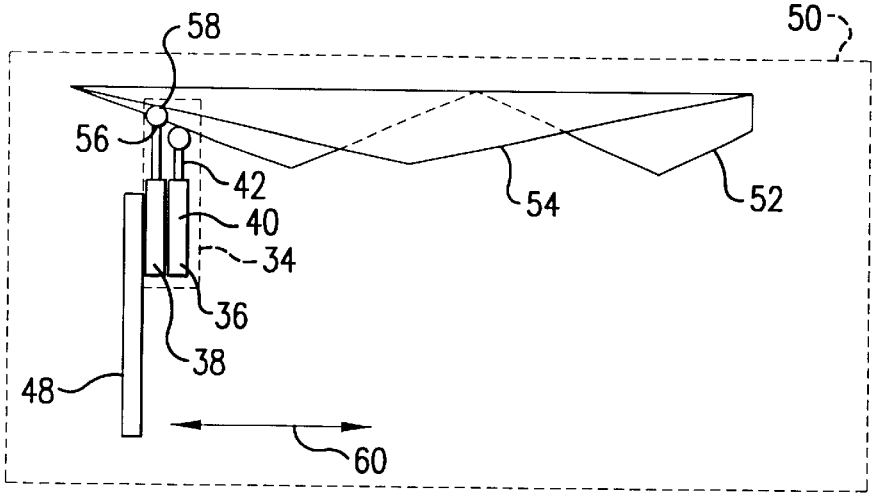
FIG. 2 is a schematic drawing illustrating a preferred embodiment of the present invention.

Referring now also to FIGS. 2 and 3, in a preferred embodiment, the sensor 34 is a sensor assembly 34 which includes two or more sensor elements 36 and 38. Each of the sensor elements 36, 38 further includes a stationary portion 40 and a movable portion 42. Each sensor element 36, 38 also includes a variable electrical element 44, such as a variable electrical resistance ( as shown in FIG. 3) or a variable electrical capacitance, for example. As the moveable portion 42 moves with respect to the stationary portion 40, the electrical value of the variable electrical element 44 changes proportionally to the movement of the moveable portion 42. For example, as shown in FIG. 3, a slidable electrical contact 46 is displaced along the variable resistance 44 with movement of the moveable portion 42. In this example, the variable resistance 44 is connected as a linear potentiometer, as is known in the art. The resistance of the potentiometer changes linearly with displacement of the sensor element moveable portion 42. For any given position of the moveable portion 42 with respect to the stationary portion 0, the potentiometer will have a specific resistance. Alternatively, the variable electrical element 44 may be a non-linear resistance, a linear or non-linear capacitance, or a linear or non-linear inductance. When connected in an electrical circuit, as is known in the art, each sensor element 36, 38 will generate an electrical output signal, the value of which is a function of the position of the slidable contact 46.

The sensor assembly 34 is fixedly attached to a movable member 48 which is moveably attached to a stationary member 50. In a preferred embodiment, the stationary member 50 includes at least two contoured surfaces 52 and 54. Each of the contoured surfaces 52, 54 is associated with one of the sensor elements 36, 38. The sensor assembly 34 is attached to the moveable member 48 in such a manner that the moveable portion 42 of each sensor element 36, 38 is in contact with the associated contoured surface 52, 54. For example, an end 56 may be in sliding contact with the associated contoured surface 52, 54, or, alternatively, the moveable portion 42 may have a wheel or roller 58 rotatably mounted at the end 56 and be in rolling contact with the associated contoured surface 52, 54. Alternatively, the sensor assembly 34 may be fixedly attached to the stationary member 50 while the moveable member 48 includes at least two contoured surfaces 52 and 54. Similarly, each of the contoured surfaces 52, 54 is associated with the moveable portion 42 of one of the sensor elements 36 and 38. The contoured surfaces 52, 54 are disposed on a surface of the moveable member 48 and adapted in such a manner that as the moveable member 48 moves with respect to the stationary member 50, the moveable portion 42 of each sensor element 36, 38 is in contact with the associated contoured surface 52, 54 and follows the profile of the associated contoured surface 52, 54.

As the moveable member 48 moves or is displaced with respect to the stationary member 50 in the directions indicated by the arrow 60, for example, the sensor elements 36, 38 will move along with the movement member 48 and the end 56 of the moveable portion 42 of each sensor element will follow the surface of the associated contoured surfaces 52, 54 (for example, in a "cam and cam-follower" relationship). In turn, as a result of the displacement of the moveable member 48 with respect to the stationary member 50, the moveable portion 42 of each sensor element 36, 38 will be displaced a proportional amount with respect to the stationary portion 40 in the directions shown by the arrow 62. The contoured surfaces 52, 54 are designed with sufficient rise and fall (i.e., positive and negative slope) and transitions (i.e., peaks and valleys) to insure full travel of the moveable portion 42 and to insure that the direction of travel of the moveable portion 42 with respect to the stationary portion 40 reverses at least once over the range of travel of the moveable member 48 with respect to the stationary member 50.

Figure 4:
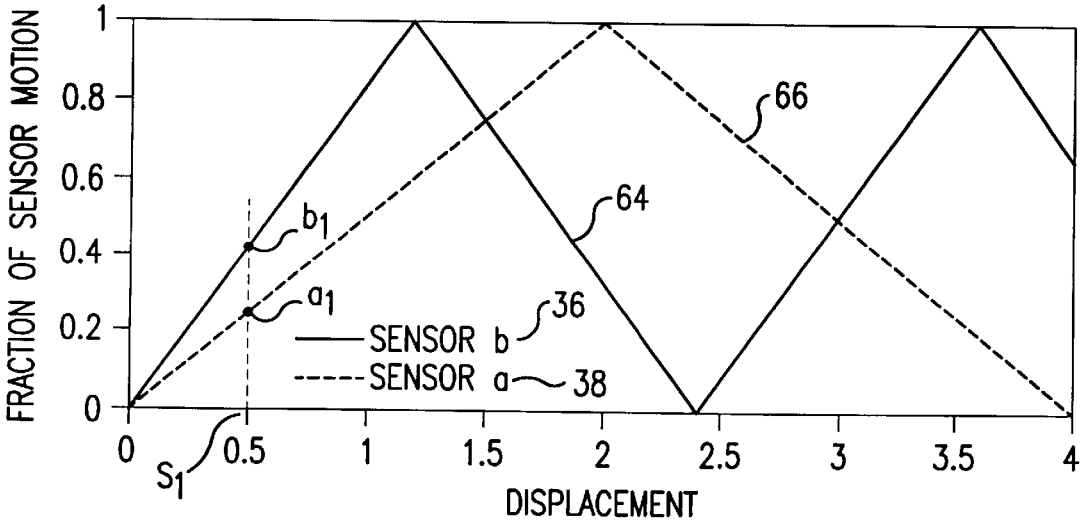
FIG. 4 is a graph illustrating sensor motion with respect to displacement of a movable member.

Referring now also to FIG. 4, a set of graphs illustrating the output signals of the sensor elements 36 and 38 is shown. The output signal for each sensor element 36 and 38, also referred to as sensor b and sensor a, respectively, is shown as a triangular waveform (idealized for clarity) 64 and 66, respectively, where the horizontal axis represents displacement or position of the moveable member 48 with respect to the stationary member 50 and the vertical axis represents the fraction of full travel for the sensor element moveable portion 42 with respect to the stationary portion 40. As the moveable member 48 is displaced or moved with respect to the stationary member 50, the motion of the moveable portion 42 of sensor a, 38, and sensor b, 36, will follow the profile of the associated contoured surface 54 and 52, respectively. In a linear system, the output signal of the sensor elements 36, 38 will follow the general profile of the associated contoured surface 52, 54. The output signal for sensor a, 38, over the range of travel for the moveable member 48 is plotted in graph 66, while graph 64 shows the output signal for sensor b, 36, over the same range of travel for the moveable member 48. When considering the output signal for a single sensor element, sensor a, 38, for example, a given output $a_1$ will not correspond to a unique position of the moveable member 48. However, the output of both sensor elements, sensor a, 38, and sensor b, 36, form a set of values, $a_1$, $b_1$, which correspond to a unique position, $S_1$, of the moveable member 48. Using two or more sensor elements 36, 38 in combination provides a one-to-one correlation between the output of the sensors and the position of the moveable member 48 with respect to the stationary member 50 along the entire range of movement of the moveable member 48. The profile of the contoured surface associated with a given sensor element must be different than the profiles of the contoured surface associated with each of the other sensor elements. Also, the profiles of the contoured surfaces 52, 54 are designed such that the reversal point for the motion of each sensor moveable portion 42 is not near the reversal point of another of the sensor elements which increases the accuracy of the system near the reversal points and insures that the unique one-to-one relationship (output to position) is maintained.

The output signals of the sensor assembly 34 may be utilized for many purposes. For example, in a preferred embodiment, the output signals may be used directly to calculate the displacement of the moveable member 48 with respect to stationary member 50. Alternatively, the output signals of the sensor assembly 34 may be used either directly or indirectly to provide a measurement or dimension of an article or object associated with the moveable member 48.

Figure 5:
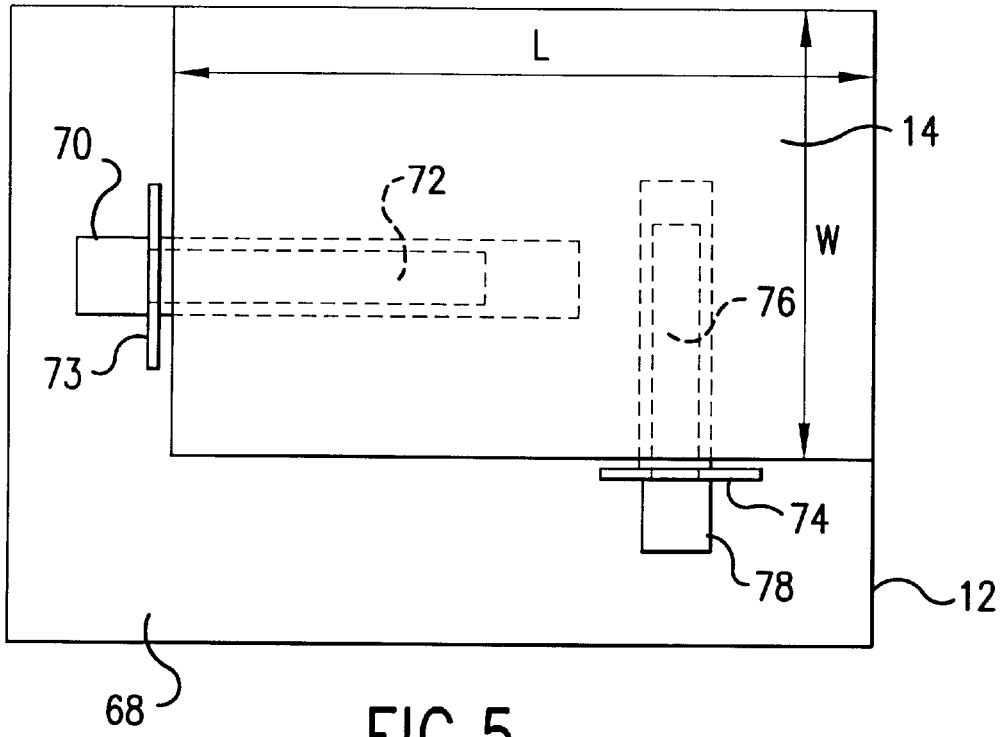
FIG. 5 is a top plan view of a printer paper supply bin implementing the present invention.
Figure 6:
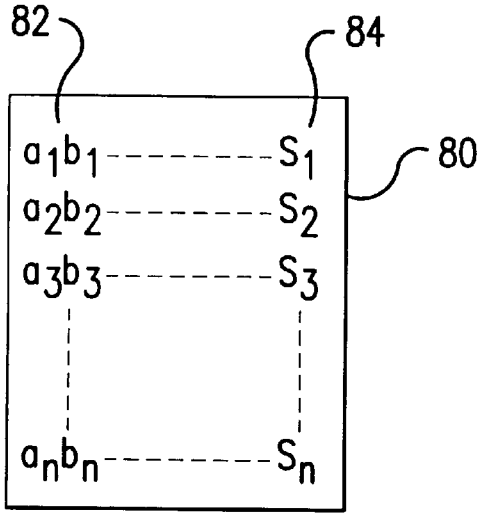
FIG. 6 is a lookup table correlating a physical characteristic of an article with sensor output according to the present invention.

Referring now also to FIGS. 5 and 6, in a preferred embodiment, the sensor assembly 34 of the present invention is implemented in a printer system 10 (as shown in FIG. 1) to measure the size of sheets 14 of print media loaded or stacked in a print media input tray 12. The print media supply bin or input paper tray 12 includes a rigid bottom member or plate 68 upon which sheets 14 of print media can be stacked. Typically, the sheets 14 of print media will also be confined by vertical walls (not shown) extending from the edges of the bottom plate 68. The bottom plate 68 includes a channel 70 formed therein for receiving a slidably mounted support 72 therein, the position of the support 72 being adjustable with respect to the input tray bottom plate 68. At one end of the support 72 a vertically extending wall or fence 73 is fixedly mounted to the support 72 and is moveable therewith. The fence 73 serves as a "media stop" restraining and confining the sheets 14 of print media in the proper position for feeding to the printer. The fence 73 is adjustable, sliding in the channel 70, to provide for print media or paper of differing sizes to be stacked in the paper tray 12. The range of movement for the fence 73 can be as great as 10 to 12 inches to accommodate the various sizes of print media typically used in a large, general purpose print system. In another embodiment, an additional fence 74 fixedly attached on a support 76 will be slidably mounted in a second channel 78 formed in the bottom plate 68. As described above with respect to the adjustable fence 73, the position of the fence 74 is also adjustable with respect to the bottom plate 68 thus the print media sizes receivable by the input tray 12 to vary both in length (L) and in width (W).

As described above with reference to FIGS. 2, 3 and 4, the sensor assembly 34 of the present invention is fixedly attached to the media stop, fence 73, at a convenient location. In a preferred embodiment, the sensor assembly 34 may be attached to portion of the fence 73 extending beyond a lower surface (not shown) of bottom plate 68 with the associated contoured surfaces 52, 54 disposed on the lower surface of the bottom plate 68 for cooperation with the sensor element moveable portions 42 (as shown in FIG. 2). When print media, such as paper, for example, is stacked in the paper input tray 12, the position of the fence 73 is adjusted to confine and restrain the paper in its proper position. As the fence 73 is moved to the desired position, the moveable portion 42 of each sensor element 36, 38 of the sensor assembly 34 will move to a position with respect to the stationary portion 40 corresponding to the position of the fence 73 with respect to the input tray bottom plate 68. The output signals of the sensor elements, sensor a and sensor b, for example, $a_1$, $b_1$, corresponding to the position of the fence 73 will be transmitted to the printer CPU 32 (as shown in FIG. 1) to control the printer operation. In the CPU 32, the sensor assembly 34 output signals preferably are used to reference a look-up table 80 (as shown in FIG. 6) to obtain the print media size corresponding to the position of the fence 73. For each set of sensor element output signals, $a_1$, $b_1$, $a_2$, $b_2$, $a_3$, $b_3$ . . . $a_n$, $b_n$ 82 the look-up table 80 will have a corresponding print media size, $S_1$, $S_2$, $S_3$ . . . $S_n$ 84. Alternatively, the printer CPU 32 could use the sensor assembly 34 output signals directly without reference to a look-up table.

In addition to the foregoing, the logic of the present invention, including the lookup table shown in FIG. 5 can be implemented in hardware, software, firmware, or a combination thereof. In the preferred embodiment(s), the logic is implemented in software or firmware that is stored in a memory and that is executed by a suitable instruction execution system. If implemented in hardware, as in an alternative embodiment, the logic can be implemented with any or a combination of the following technologies, which are all well known in the art: a discrete logic circuit(s) having logic gates for implementing logic functions upon data signals, an application specific integrated circuit (ASIC) having appropriate logic gates, a programmable gate arrays(s) (PGA), a field programmable gate array (FPGA), etc.

While having described and illustrated the principles of the present invention with reference to various preferred embodiments and alternatives, it will be apparent to those familiar with the art that the invention can be further modified in arrangement and detail without departing from those principles. Accordingly, it is understood that the present invention includes all such modifications that come within the terms of the following claims and equivalents thereof.

What is claimed is:

1. An apparatus for measuring the displacement of a movable member, comprising:

a movable member;

a stationary member; and at least two sensors, each sensor having a movable portion and a stationary portion;

wherein each sensor is attached to the movable member, the movable portion of each sensor being in contact with an associated contoured surface of the stationary member such that, responsive to displacement of the movable member with respect to the stationary member, the movable portion of each sensor follows its associated contoured surface thereby producing movement of the movable portion with respect to the stationary portion of each sensor, each sensor generating an output signal indicative of a position of the movable member with respect to the stationary member.

2. The apparatus as in claim 1 wherein the movable portion of each sensor includes a surface in sliding contact with the associated contoured surface.

3. The apparatus as in claim 1 wherein the movable portion of each sensor includes a rotatably-mounted wheel, the wheel being in rolling contact with the associated contoured surface.

4. The apparatus as in claim 1 wherein the stationary portion of each sensor includes a variable electrical element.

5. The apparatus as in claim 4 wherein the variable electrical element comprises a variable capacitance.

6. The apparatus as in claim 4 wherein the variable electrical element comprises a variable resistance.

7. The apparatus as in claim 4 wherein the variable electrical element comprises a variable inductance.

8. The apparatus as in claim 1 wherein all defined positions of the movable member with respect to the stationary member are stored in a lookup table, the output signals generated by the sensors when the movable member is at any defined position being indicative of the lookup table location of that defined position.

9. The apparatus as in claim 8 wherein each of the defined positions is associated with a dimension of an article associated with the movable member.

10. The apparatus as in claim 8 wherein each of the defined positions is indicative of the size of an article associated with the movable member.

11. An apparatus for measuring the displacement of a movable member, comprising:

a movable member;

a stationary member; and at least two sensors, each sensor having a movable portion and a stationary portion;

wherein each sensor is attached to the stationary member, the movable portion of each sensor being in contact with an associated contoured surface of the movable member such that, responsive to displacement of the movable member with respect to the stationary member, the movable portion of each sensor follows its associated contoured surface thereby producing movement of the movable portion with respect to the stationary portion of each sensor, each sensor generating an output signal indicative of a position of the movable member with respect to the stationary member.

12. The apparatus as in claim 11 wherein the movable portion of each sensor includes a surface in sliding contact with the associated contoured surface.

13. The apparatus as in claim 11 wherein the movable portion of each sensor includes a rotatably-mounted wheel, the wheel being in rolling contact with the associated contoured surface.

14. The apparatus as in claim 11 wherein the stationary portion of each sensor includes a variable electrical element.

15. The apparatus as in claim 14 wherein the variable electrical element comprises a variable capacitance.

16. The apparatus as in claim 14 wherein the variable electrical element comprises a variable resistance.

17. The apparatus as in claim 14 wherein the variable electrical element comprises a variable inductance.

18. The apparatus as in claim 11 wherein all defined positions of the movable member with respect to the stationary member are stored in a lookup table, the output signals generated by the sensors when the movable member is at any defined position being indicative of the lookup table location of that defined position.

19. The apparatus as in claim 18 wherein each of the defined positions is associated with a dimension of an article associated with the movable member.

20. The apparatus as in claim 18 wherein each of the defined positions is indicative of the size of an article associated with the movable member.

* * * * *